US011220313B2

(12) United States Patent
Hovde

(10) Patent No.: US 11,220,313 B2
(45) Date of Patent: Jan. 11, 2022

(54) MOORING LINE LENGTH ADJUSTING DEVICE AND METHOD

(71) Applicant: APL NORWAY AS, Kolbjørnsvik (NO)

(72) Inventor: Geir Olav Hovde, His (NO)

(73) Assignee: APL NORWAY AS, Kolbjørnsvik (NO)

( * ) Notice: Subject to any disclaimer, the term of this patent is extended or adjusted under 35 U.S.C. 154(b) by 0 days.

(21) Appl. No.: 16/647,258

(22) PCT Filed: Sep. 12, 2018

(86) PCT No.: PCT/NO2018/000016
§ 371 (c)(1),
(2) Date: Mar. 13, 2020

(87) PCT Pub. No.: WO2019/054878
PCT Pub. Date: Mar. 21, 2019

(65) Prior Publication Data

US 2020/0269957 A1 Aug. 27, 2020

(30) Foreign Application Priority Data

Sep. 15, 2017 (NO) ..... 20171487

(51) Int. Cl.
*B63B 21/04* (2006.01)
*B63B 21/50* (2006.01)

(52) U.S. Cl.
CPC ..... *B63B 21/04* (2013.01); *B63B 21/50* (2013.01)

(58) Field of Classification Search
CPC ..... B63B 21/04; B63B 21/50; B63B 21/20; F16G 15/00
See application file for complete search history.

(56) References Cited

U.S. PATENT DOCUMENTS 5,097,787 A * 3/1992 Bruce ..... F16G 15/00 114/293
6,983,714 B2 1/2006 Dove et al.
(Continued)

FOREIGN PATENT DOCUMENTS

NO 20130615 A1 11/2014
NO 20160964 A1 12/2017
(Continued)

OTHER PUBLICATIONS

Norwegian Search Report, dated Apr. 4, 2018, for Norwegian Application No. 20171487, along with an English translation.
(Continued)

*Primary Examiner* — Anthony D Wiest
(74) *Attorney, Agent, or Firm* — Birch, Stewart, Kolasch & Birch, LLP

(57) ABSTRACT

A mooring line length adjusting device and method is disclosed. The device is arranged for connecting lower and upper mooring line section to its respective ends and for adjusting the total length of the mooring line. The upper section of the mooring line includes a chain segment at its end connected to the device. The device includes a locking element to lock the chain segment to itself. A connecting structure for a temporary pulling mechanism to pull the device in a direction to transfer tension from the upper mooring line section to the temporary pulling mechanism is a part of the device. The method discloses steps and details how to use the device.

11 Claims, 11 Drawing Sheets

(56) References Cited

U.S. PATENT DOCUMENTS

| | | | | |
|---|---|---|---|---|
| 7,421,967 | B1 | 9/2008 | Fontenot et al. | |
| 9,003,994 | B2 | 4/2015 | Leverette et al. | |
| 2014/0224163 | A1* | 8/2014 | Zijlmans ..... | B63B 21/502<br>114/230.22 |
| 2016/0176480 | A1 | 6/2016 | Hovde | |

FOREIGN PATENT DOCUMENTS

| | | | |
|---|---|---|---|
| WO | WO 89/03766 | A1 | 5/1989 |
| WO | WO 2013/004749 | A1 | 1/2013 |
| WO | WO 2013/043049 | A1 | 3/2013 |
| WO | WO 2014/083056 | A1 | 6/2014 |
| WO | WO 2014/178721 | A3 | 11/2014 |

OTHER PUBLICATIONS

International Search Report, issued in PCT/NO2018/000016, dated Nov. 16, 2018.
Written Opinion of the International Searching Authority, issued in PCT/NO2018/000016, dated Nov. 16, 2018.

* cited by examiner

MOORING LINE LENGTH ADJUSTING DEVICE AND METHOD

TECHNICAL FIELD

The present invention relates to offshore mooring systems. More specifically it relates to a subsea line length and tension adjusting device for a mooring line.

BACKGROUND

All mooring systems may require line length adjustment at some point in time, either as part of the initial installation to obtain the target line length or at a later stage to compensate for line length variation over time. Examples of root causes for line length variations over time may be corrosion or wear of chain sections or elongation of synthetic fiber ropes such as polyester ropes. Polyester ropes are especially used in mooring systems for deep to ultradeep waters, because of its beneficial weight and stiffness properties. However, one drawback with polyester ropes is that it creeps over time when subject to continuous loading. It also creeps when it experiences loads higher than it has seen earlier. Part of this creep can be mitigated by stretching the rope to a high tension during the offshore installation campaign, but for practical reasons, such as the capacity of the installation vessel and risk related to working with high loads, there is an upper limit on how much tension that can be applied. Hence, adjustment of the length of mooring lines comprising polyester rope sections may be required during the design life of the mooring system.

Related prior art is disclosed patent documents NO20130615A1, WO2014178721A3, WO2013004749A1, U.S. Pat. Nos. 9,003,994B2, 6,983,714B2 and WO2013043049A1.

The objective of the below disclosed invention is to overcome the disadvantages of the prior art in this field.

SUMMARY

The present invention is a mooring line connecting and tension adjusting device. Main goal of this invention is to facilitate and ease line length adjustments of mooring lines—both shortening and lengthening, to stay within the design envelope of the mooring arrangement for the moored unit.

The connecting device is arranged for connecting a lower section and an upper section of a mooring line to respective ends of the device and for adjusting a total length of the mooring line from a previous mooring line length to a new mooring line length. At least the upper section of the mooring line comprises a chain segment at its end connected to the device. The device comprises a locking element to lock the chain segment to itself. The locking element—when locking the chain segment to the device—divides the chain segment into a tensioned portion and a loose portion. A connecting structure for a temporary pulling means to pull the device in a direction in order to move tension from the mooring line upper section to the temporary pulling means is a part of the device.

In a preferred embodiment of the device, the locking element is attached to a body of the connecting device with a hinge to allow a change between locked and unlocked position and transfers substantially all mooring line tension load directly from the locking element to the body with substantially no tension load on the hinge.

In another preferred embodiment of the device, the temporary pulling means is an auxiliary line temporarily connecting the device to an external pulling device.

In another preferred embodiment of the device, a stopper is attached to a predefined link of the chain segment in the loose portion or the tensioned portion of the chain segment to stop the chain segment from moving further when the stopper contacts a device structure during an ongoing adjustment operation.

In another preferred embodiment of the device, an end stopper is attached to the end of the loose portion of the chain segment preventing separation from the device if the locking element—and in case of the ongoing adjustment operation also the temporary pulling means—fails to hold the upper section connected to the device.

In a further preferred embodiment of the device, the end stopper has a sufficient weight to exert a pulling force onto the chain segment to overcome friction between chain and device and potentially counteracting pulling forces from the weight of the upper section of the mooring line during the ongoing adjustment operation.

Another aspect of the invention is a method for an adjustment operation to adjust a tension in a two-section mooring line with the connecting device as disclosed above. The method comprises the following steps:

a) attaching a temporary pulling means to the connecting device and pulling with the temporary pulling means the connection device in order to move tension from the chain segment of the upper mooring line section to the pulling means,
b) unlocking the locking element,
c) moving the chain segment through the device passing the locking element,
d) re-engaging the locking element at a new mooring line length,
e) moving tension back from the temporary pulling means to the chain segment by slackening the temporary pulling means, and
f) removing the temporary pulling means.

The above method may preferably comprise an additional step before unlocking step b): assuring a chain movement limitation through the device by attaching a first stopper to a predefined link in the loose chain portion and/or a second stopper to a predefined link in the tensioned chain portion.

The method may further comprise that additional pulling means pull on the end of the loose chain portion or additional weight is attached to the end stopper.

BRIEF DESCRIPTION OF THE FIGURES

Below, various embodiments of the invention will be described with reference to the figures, in which FIG. 1 gives a typical general arrangement of a moored unit with its mooring lines.

DETAILED DESCRIPTION OF PREFERRED EMBODIMENTS

Preferred embodiments of the invention are described below with reference to the attached figures.

Figure 1:
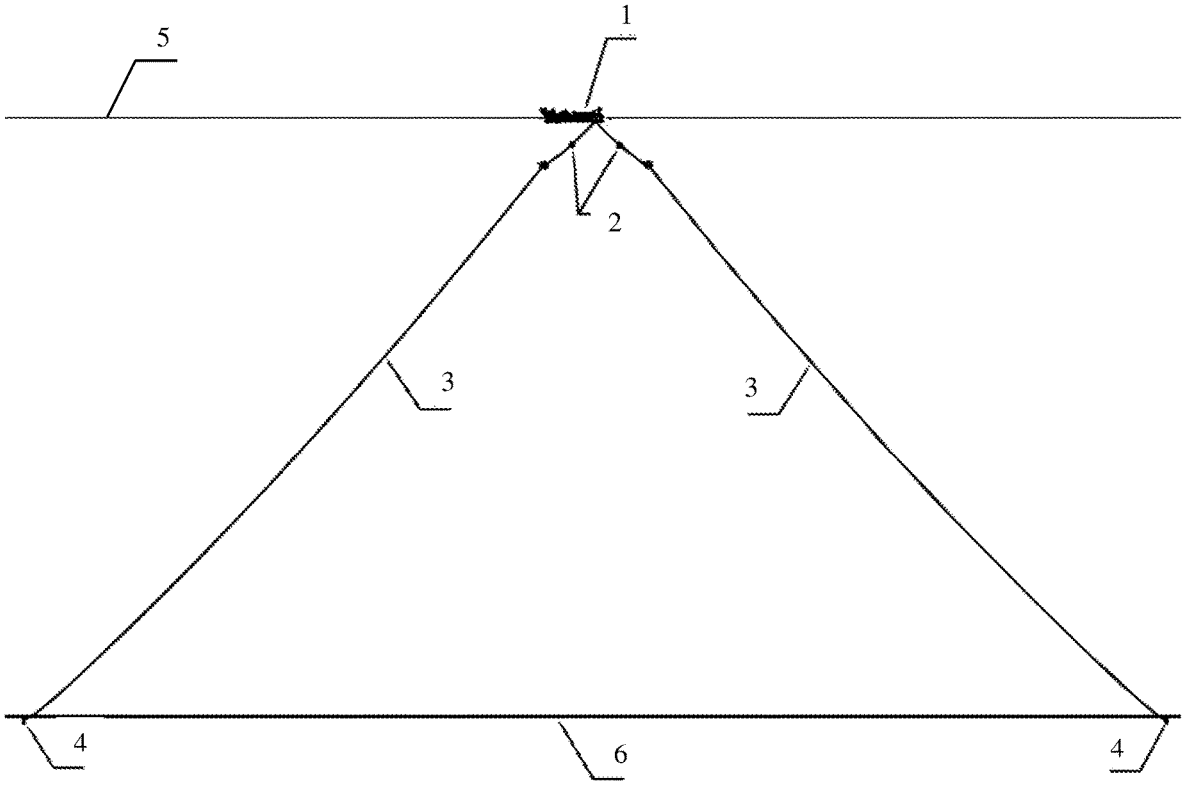

FIG. 1 gives an overall view of an arrangement using the tension adjustment device according to the invention. No major offshore campaign is necessary, and the operation can be performed with the help from a relatively small vessel in combination with an ROV (Remotely Operated Vehicle) and the moored vessel itself, without opening the mooring line 3. The line length adjusting operation is conducted with a pulling device onboard the moored unit 1 (or another floating unit) together with a minor surface vessel equipped with a winch, crane or A-frame, as well as an ROV that can observe the operation and conduct minor operations such as connecting and disconnecting the pull line, attach and remove weight and other small parts.

The inventive line length adjusting device 2 is located subsea in series with the mooring line between the moored unit 1 at the sea surface 5 and the mooring line anchor 4 on the sea floor 6.

Figure 2:
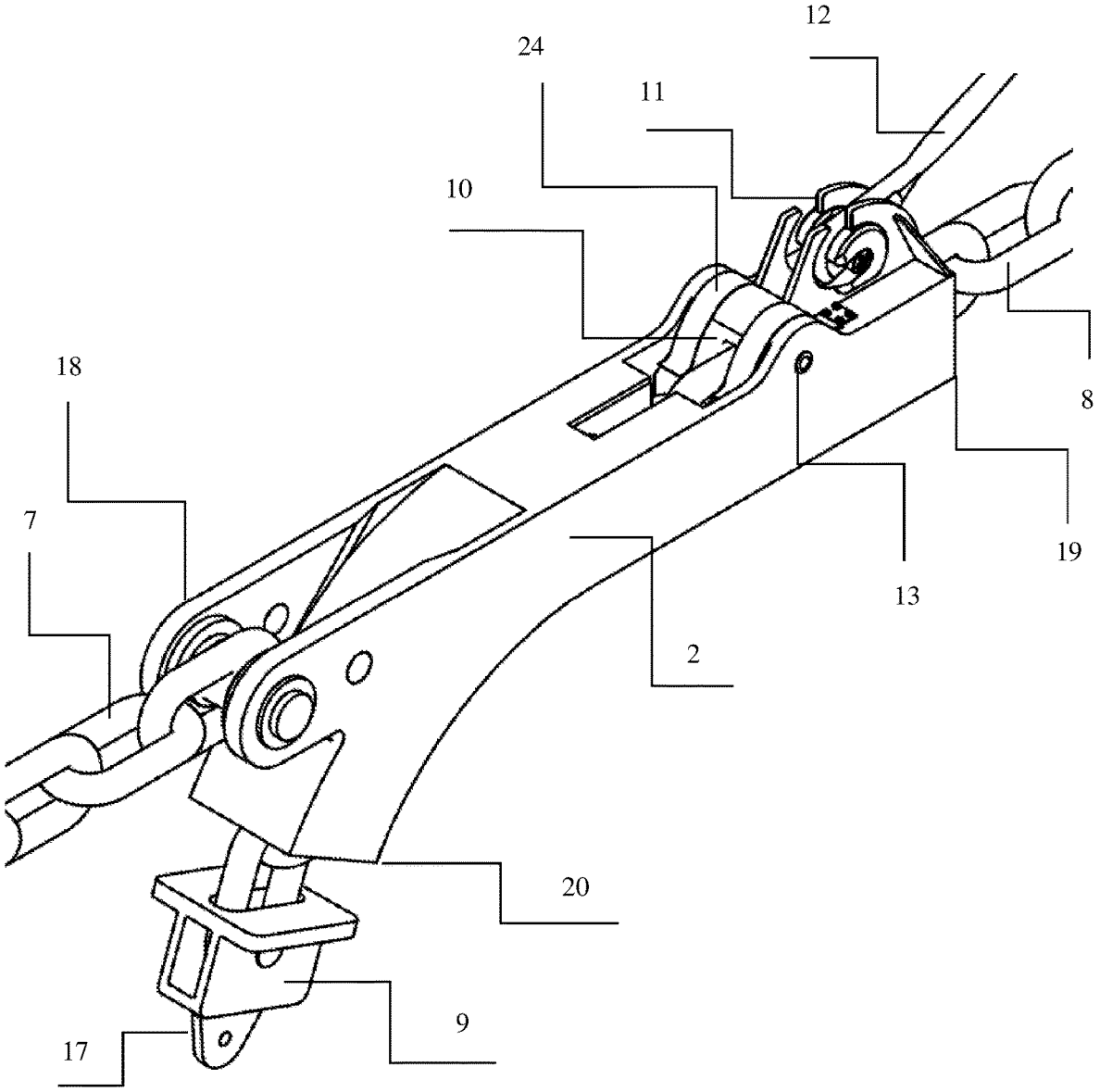
FIG. 2 shows the general arrangement of the adjusting device
Figure 3:
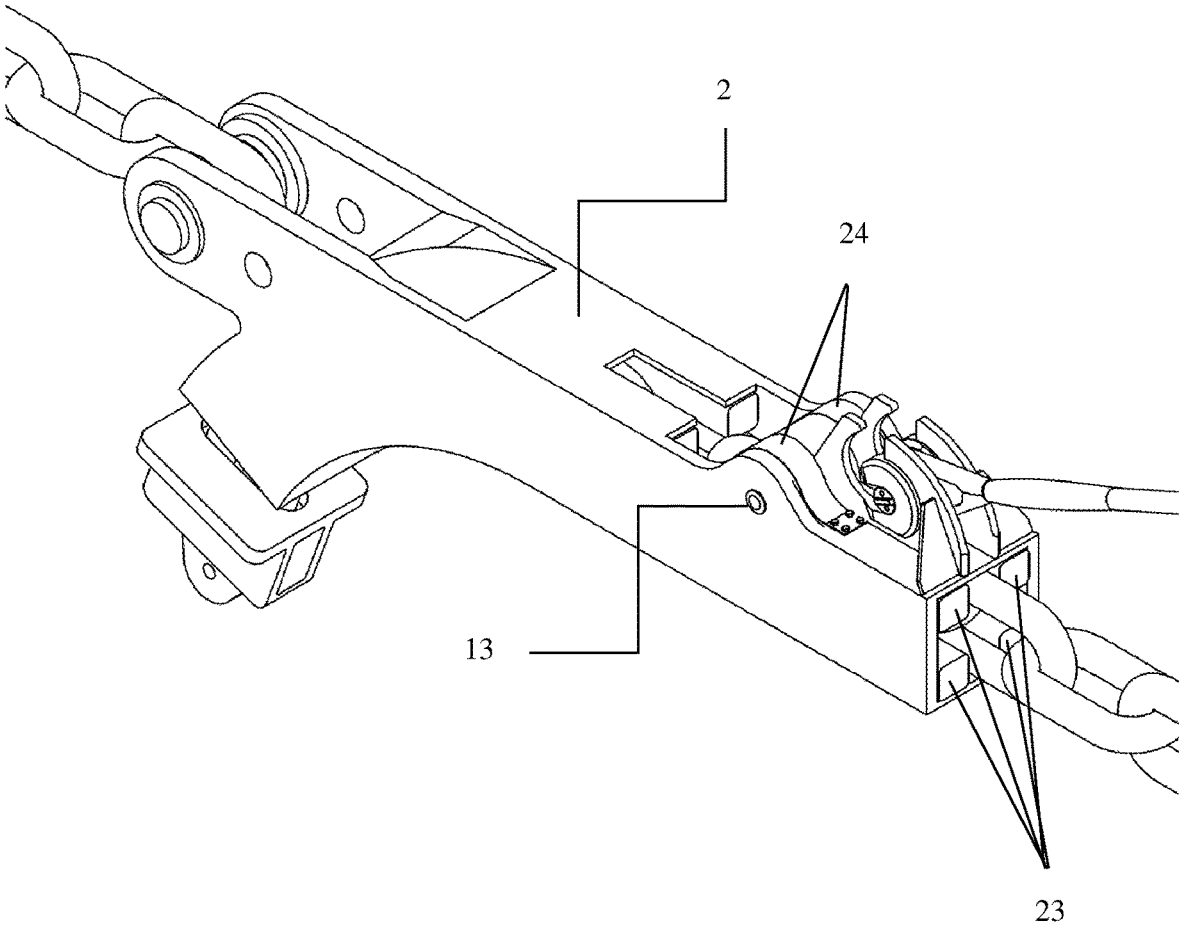
FIG. 3 shows the general arrangement of the adjusting device
Figure 4:
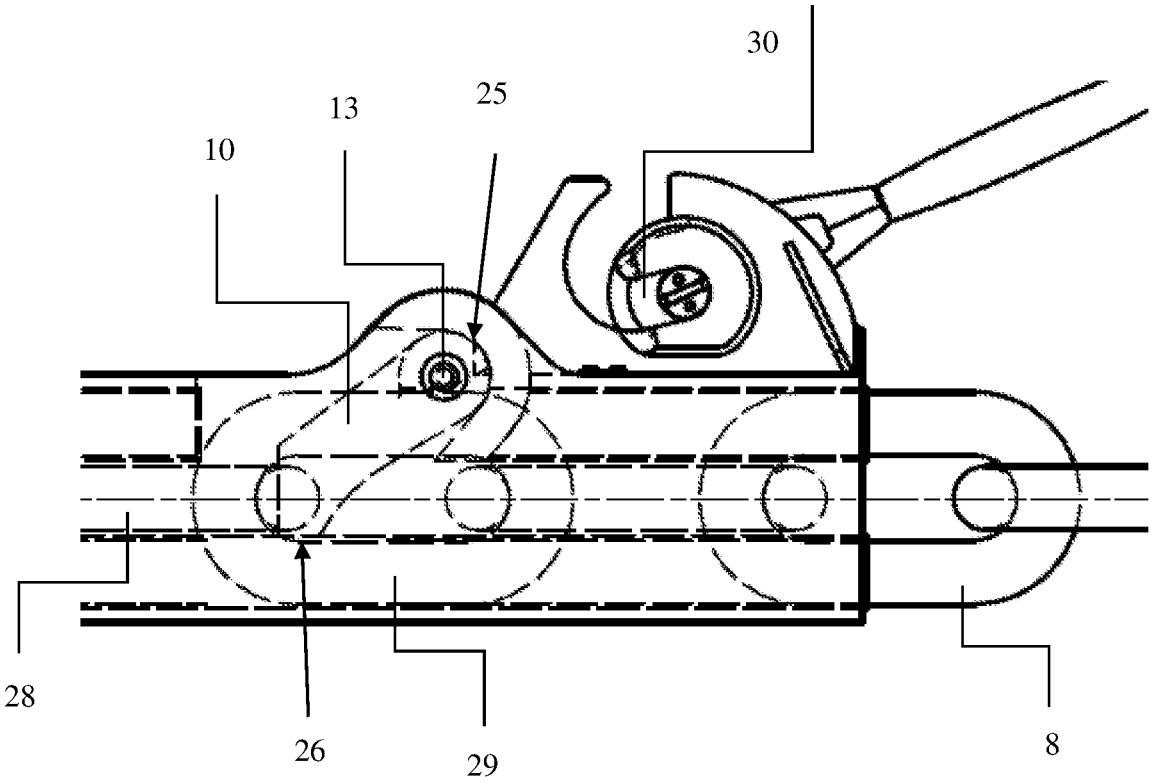
FIG. 4 shows the location of the locking element inside the device

With reference to FIGS. 2, 3 and 4, the adjusting device has a lower end 18 permanently fixed to the lower mooring line section 7 located between the anchor 4 and the device, and an upper end 19 locked to a chain end 8 of the upper mooring line section running through the device. Orientation of the chain inside the device is controlled by four chain guides 23. A horizontal chain link 28 of the chain end 8 is locked to the device by a locking element 10 inside the device. When locked, the chain has a loose end 14 exiting the device at an exit point 20 between the lower end 18 and the upper end 19. At the end of the loose end a chain stopper 9 can be attached. This stopper will preferably have a pad eye 17 for connecting additional weight if required, or weight can also be attached directly to the end of the loose chain end 14 if a stopper 9 is not used.

Figure 5:
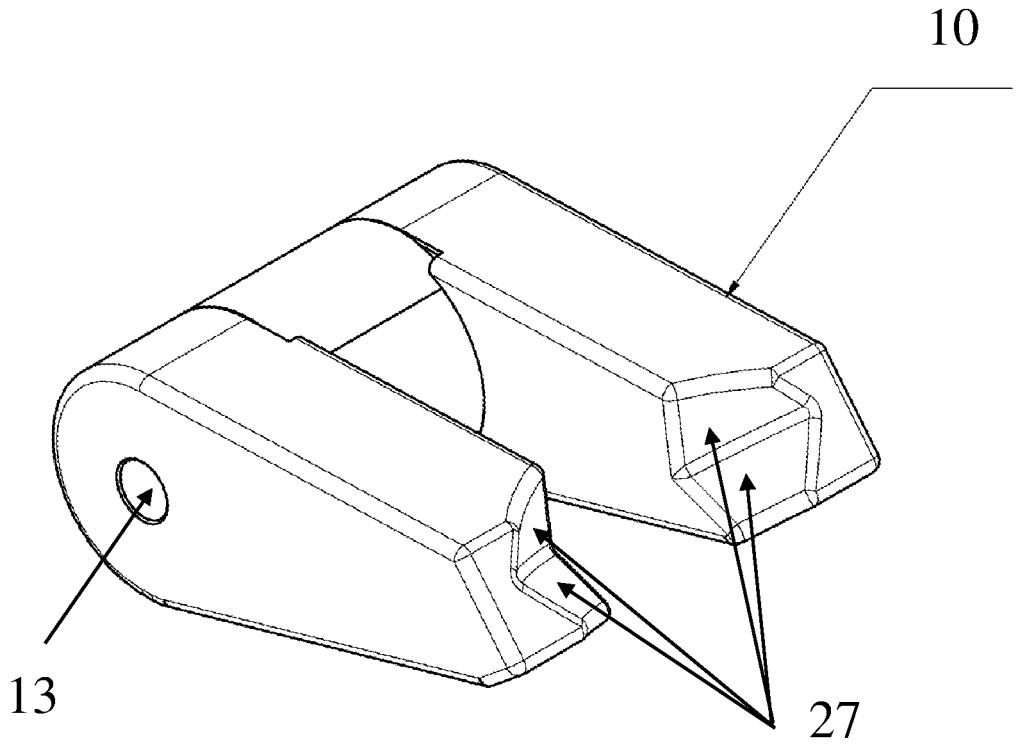
FIG. 5 shows the chain locking element of the line length adjusting device.

FIG. 5 shows a preferred embodiment of the locking element 10. It is located in the adjusting device 2 and rotatably hinged to a pin 13, positioned close to the top of the device. The locking element 10 disengages the chain segment when the chain segment is moving towards the lower end 20,18 of the device, but locks the chain segment when the chain segment is pulled in the opposite direction. The closing of the locking element can be by gravity or by spring(s) 24, or a combination thereof.

The load transfer between the locking element 10 and the body of the adjusting device 2 is directly between the body of the locking element and the body of the device 2, and between the locking element and the two lowest of the four chain guides 23, confer FIG. 4. No substantial load goes through the pin 13. The contact point between the horizontal chain link 28 and the locking element 10 is via the surfaces 27 on the locking element.

Figure 6:
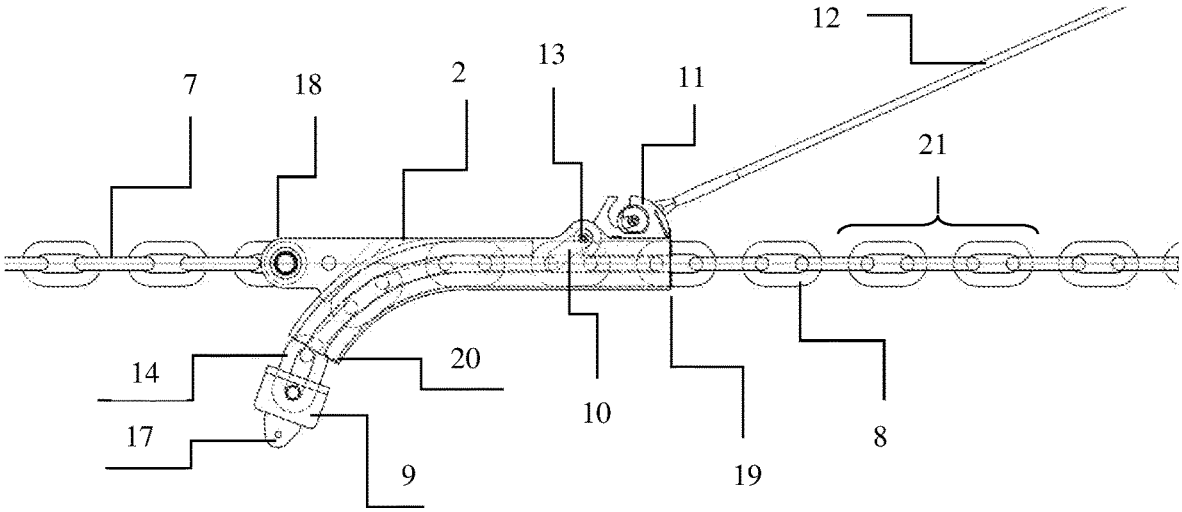
FIG. 6 shows a section view of the line length adjusting device
Figure 7:
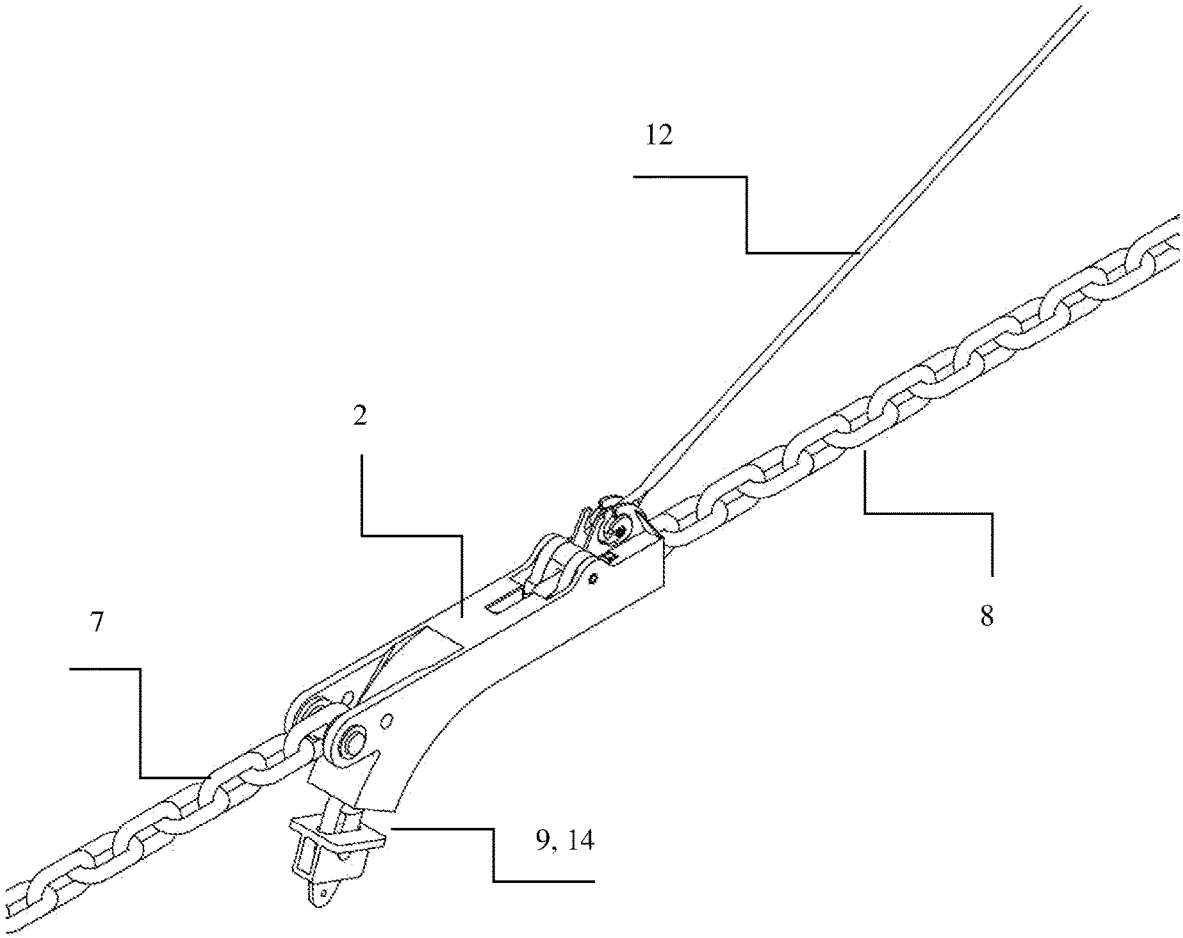
FIG. 7 shows the adjusting device and interfacing components with pull line
Figure 9:
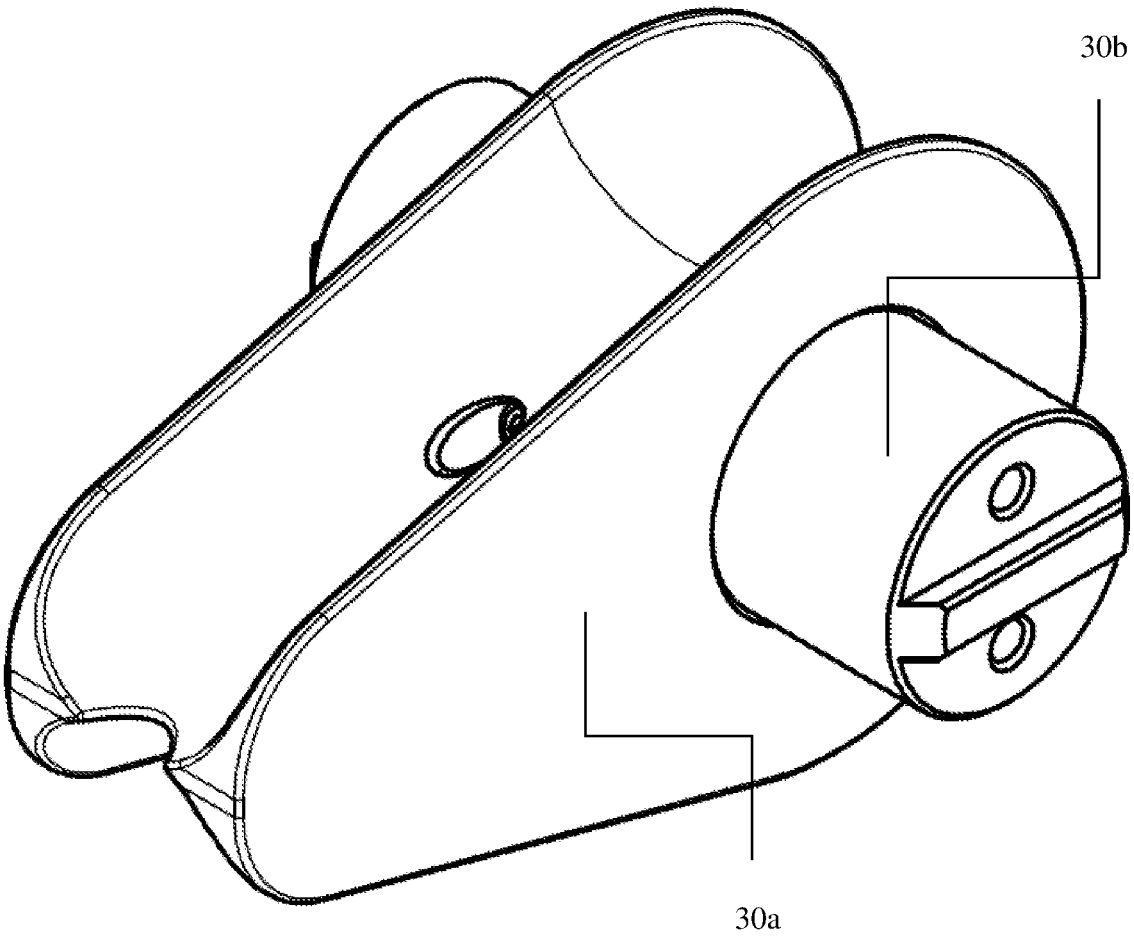
FIG. 9 shows thimble with integrated pin for pull line

FIGS. 6, 7 and 9 illustrate a temporary pull line 12 with a thimble 30 connected to the device. A pull line connecting structure 11 is located on top of the device at its upper end 19. The thimble 30 comprises a body 30*a* and a pin 30*b*, which are assembled before the temporary pull line 12 with thimble 30 is connected to the device 2. The connecting structure 11 on the adjusting device 2 has two guides, one on each side of the thimble body 30*a*, and each guide is in direct contact with the pin 30*b*, but with opposite ends of the pin. The guiding structure also provides structural strength for transferring the load from the pull line 12 into the device 2.

Figure 8:
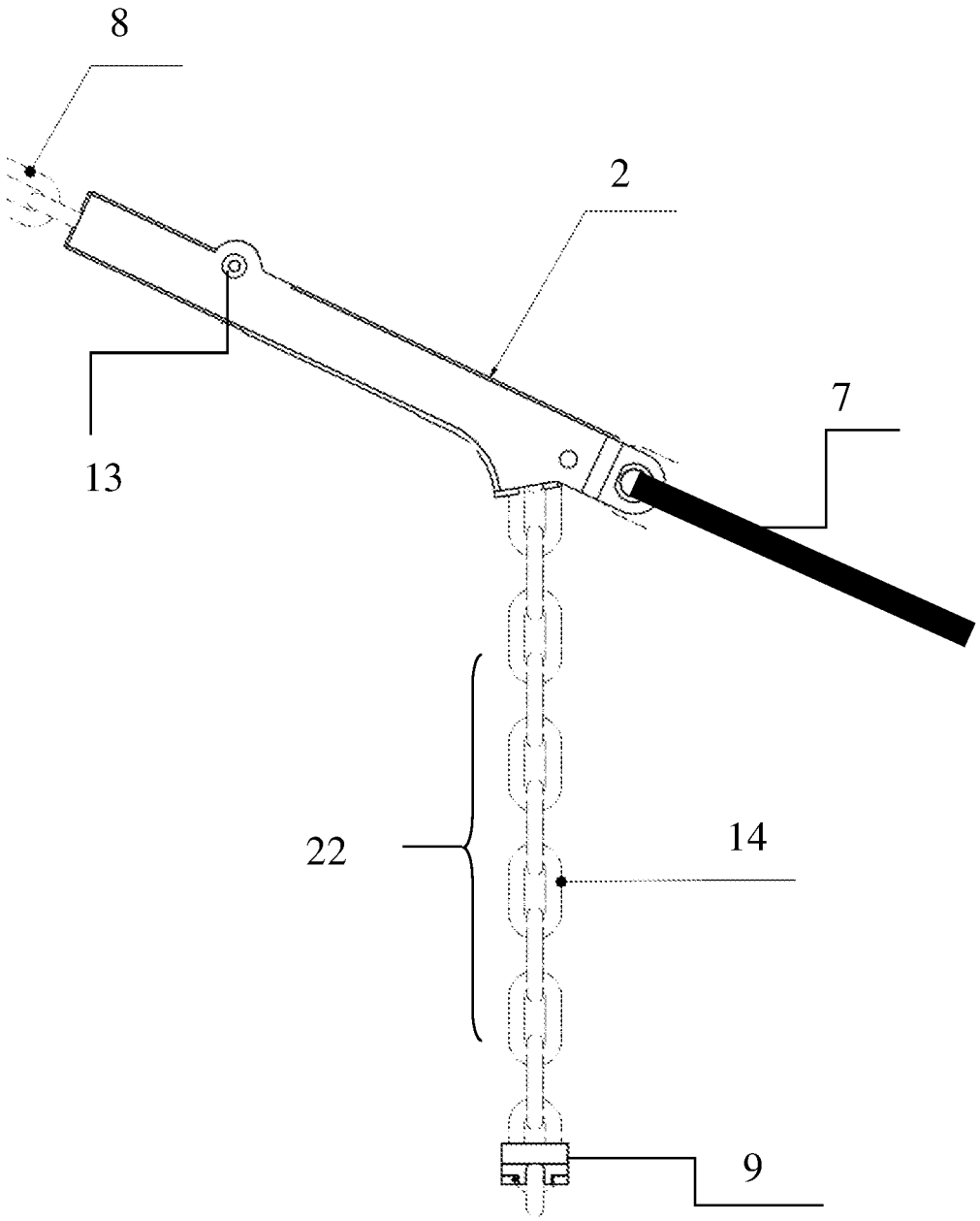
FIG. 8 shows the line length adjusting device before/after length adjustment
Figure 10:
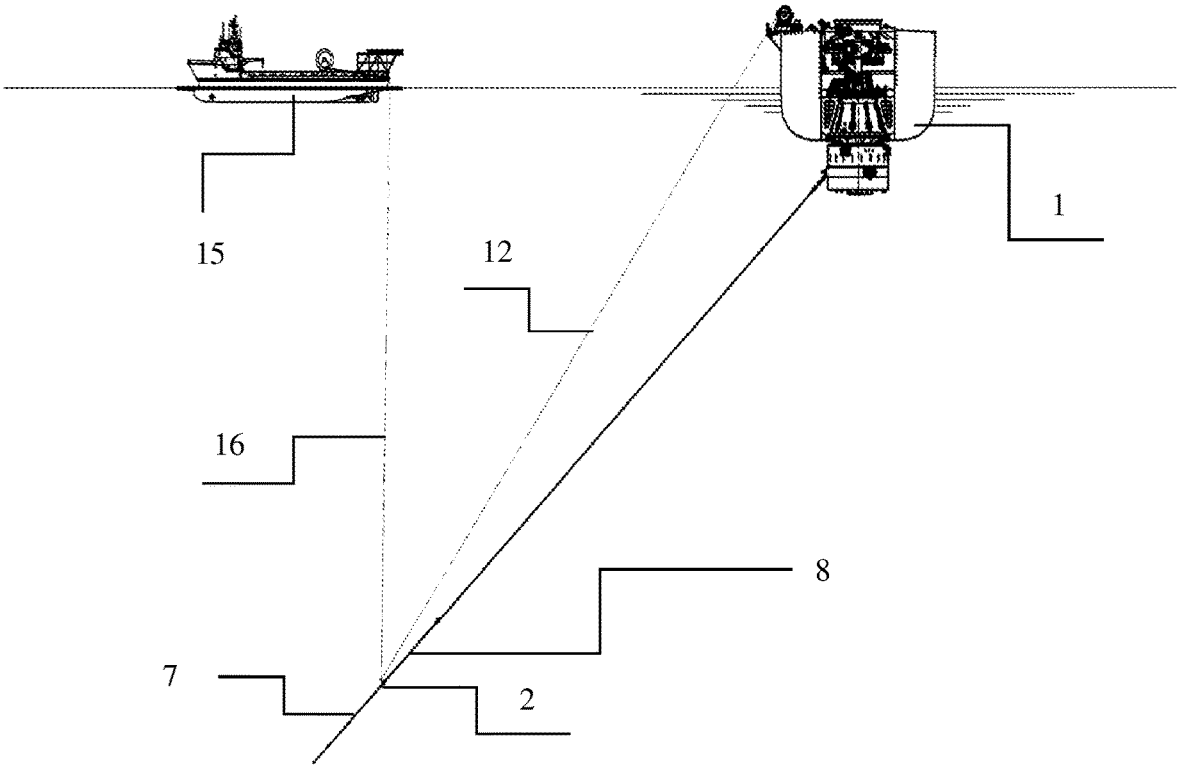
FIG. 10 shows the arrangement before the tension in the upper line section is relieved
Figure 11:
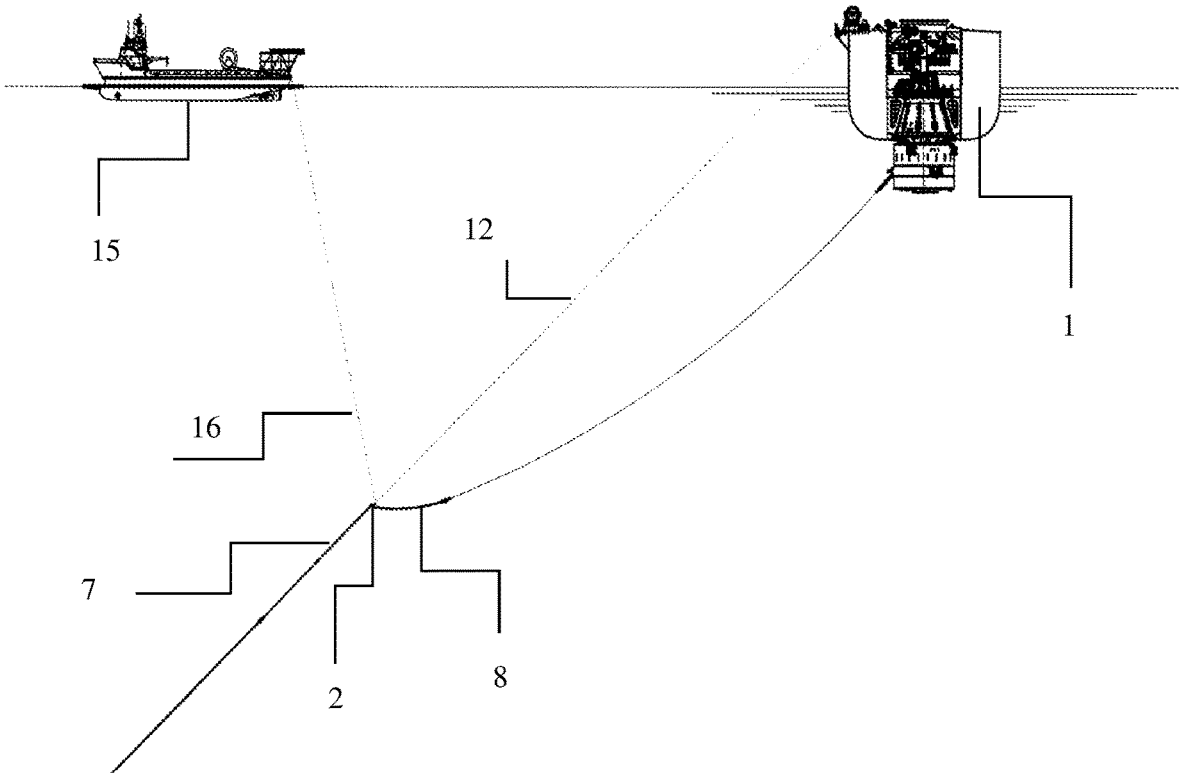
FIG. 11 shows the arrangement after the tension in the upper line section is relieved

FIGS. 8, 10 and 11 illustrate a line tension adjusting operation.

During such an operation, a supporting surface vessel 15 is handed the lower end of the pull line 12 from the moored vessel. The other end of the pull line will typically be attached to a winch onboard the moored vessel 1. With the help of an ROV the support vessel will connect the lower end of the pull line 12 to the connecting structure 11 on the device 2. If the loose chain segment end 14 and chain stopper 9 do not have enough weight to pull the chain segment 8 of the upper line section through the device, then the supporting vessel 15 will attach weight to the loose end of the chain segment 14 or the pad eye 17 of the stopper 9. Other ways to pull on the loose chain end may also be used, such as by a winch or similar. The supporting vessel 15 may also (temporarily) attach a stopper to the proper chain link 21,22 to make sure the chain segment does not move too far when the moored unit 1 pulls on the pull line 12. When the chain segment has moved the correct distance, the moored unit 1 relaxes the pull line such that the locking element 10 fully engages with the chain again, and the mooring line tension is transferred from the pull line 12 and back to the upper mooring line section.

When the objective is to make the line 3 longer instead of shorter the procedure will be very similar. Main difference is that the locking element 10 needs to be lifted, typically by an ROV. The locking element 10 can be lifted when no physical contact (load) between the locking element 10 and the horizontal chain link 28 at the surfaces 27 exists. This contact is no longer present when the tension in the upper section is transferred to the pull line 12, and when the weight of the loose end 14, weight of the end stopper 9 or any other weights attached to the loose end 14 or the end stopper 9, or by any other pulling means on the loose end 14 has pulled the chain link 28 away from the locking element 10. When this contact has been removed the locking element 10 can be lifted. By transferring tension from the pull line 12 back to the upper section of the mooring line the chain through the device 2 will move in the direction such that the loose end 14 gets shorter and the upper section of the mooring line gets longer.

REFERENCE NUMERALS

1 Moored vessel
2 Line length adjusting device
3 Mooring line
4 Mooring anchor
5 Sea surface
6 Sea floor
7 Fixed end of lower mooring line section
8 Adjustable end of upper mooring line section
9 Chain stopper
10 Chain locking element
11 Connecting structure for temporary pull line
12 Temporary pull line
13 Rotation point (hinge) for chain locking element
14 Loose chain end
15 Supporting surface vessel
16 Lifting line for extra weight to be attached to the loose chain end or umbilical to supporting ROV

17 Pad eye for connecting extra weight, if required
18 Lower end of device
19 Upper end of device/chain entrance
20 Exit point for loose chain
21 Potential stopper position when shortening the mooring line
22 Potential stopper position when lengthening mooring line
23 Chain guide inside device
24 Spring
25 Contact point for load transfer between locking element and device body
26 Contact point for load transfer between locking element and chain guide
27 Contact point for load transfer between locking element and horizontal link
28 Horizontal link
29 Vertical link
30 Thimble with integrated/fixed pin
**30*a*** Thimble body
**30*b*** Integrated/fixed pin

The invention claimed is:

1. A connecting system comprising a connecting device and a mooring line, the connecting device being arranged for connecting a lower section and an upper section of the mooring line to respective ends of the connecting device and for adjusting a total length of said mooring line from a previous mooring line length to a new mooring line length, where at least said upper section of the mooring line comprises a chain segment at an end thereof connected to the connecting device, and the connecting device comprising:

a locking element to lock said chain segment to the connecting device, the locking element—when locking said chain segment to the connecting device—dividing said chain segment into a tensioned portion and a loose portion; and a connecting structure for a temporary pulling mechanism to pull the connecting device in a direction to move tension from said mooring line upper section to said temporary pulling mechanism, wherein an end stopper is attached to an end of said loose portion of the chain segment, and said end stopper has a weight that exerts a pulling force onto the chain segment to overcome friction between the chain and the connecting device and counteracting pulling forces from a weight of the upper section of the mooring line during an ongoing adjustment operation.

2. The connecting system according to claim 1, wherein said locking element is attached to a body of the connecting device with a hinge to allow a change between a locked and an unlocked position, the locking element transferring substantially all mooring line tension load directly from the locking element to the body with substantially no tension load on said hinge.

3. A method for an adjustment operation to adjust a tension in a two-section mooring line with the connecting system according to claim 2, the method comprising the following steps:

a) attaching a temporary pulling mechanism to the connecting device and pulling with the temporary pulling mechanism the connection device to move tension from said chain segment of the upper mooring line section to said pulling mechanism;

b) unlocking said locking element;

c) moving said chain segment through the connecting device passing said locking element;

d) re-engaging said locking element at a new mooring line length;

e) moving tension back from said temporary pulling mechanism to said chain segment by slackening said temporary pulling mechanism; and f) removing said temporary pulling mechanism.

4. The connecting system according to claim 1, wherein said temporary pulling mechanism is an auxiliary line temporarily connecting the connecting device to an external pulling mechanism.

5. A method for an adjustment operation to adjust a tension in a two-section mooring line with the connecting system according to claim 4, the method comprising the following steps:

a) attaching a temporary pulling mechanism to the connecting device and pulling with the temporary pulling mechanism the connection device to move tension from said chain segment of the upper mooring line section to said pulling mechanism;

b) unlocking said locking element;

c) moving said chain segment through the connecting device passing said locking element;

d) re-engaging said locking element at a new mooring line length;

e) moving tension back from said temporary pulling mechanism to said chain segment by slackening said temporary pulling mechanism; and f) removing said temporary pulling mechanism.

6. The connecting system according to claim 1, wherein a stopper is attached to a predefined link of said chain segment in the loose portion or the tensioned portion of the chain segment, to stop the chain segment from moving further when the stopper contacts the connecting device during the ongoing adjustment operation.

7. A method for an adjustment operation to adjust a tension in a two-section mooring line with the connecting system according to claim 6, method comprising the following steps:

a) attaching a temporary pulling mechanism to the connecting device and pulling with the temporary pulling mechanism the connection device to move tension from said chain segment of the upper mooring line section to said pulling mechanism;

b) unlocking said locking element;

c) moving said chain segment through the connecting device passing said locking element;

d) re-engaging said locking element at a new mooring line length;

e) moving tension back from said temporary pulling mechanism to said chain segment by slackening said temporary pulling mechanism; and f) removing said temporary pulling mechanism.

8. A method for an adjustment operation to adjust a tension in a two-section mooring line with the connecting system according to claim 1, the method comprising the following steps:

a) attaching a temporary pulling mechanism to the connecting device and pulling with the temporary pulling mechanism the connection device to move tension from said chain segment of the upper mooring line section to said pulling mechanism;

b) assuring a chain movement limitation through the connecting device by a first stopper to a predefined link in the loose chain portion;

c) unlocking said locking element;

d) moving said chain segment through the connecting device passing said locking element;

e) re-engaging said locking element at a new mooring line length;

f) moving tension back from said temporary pulling mechanism to said chain segment by slackening said temporary pulling mechanism; and g) removing said temporary pulling mechanism.

9. The method according to claim 8, further comprising an additional step of, before unlocking step g):

assuring a chain movement limitation through the connecting device by attaching a second stopper to a predefined link in the tensioned chain portion.

10. The method according to claim 9, wherein the end stopper pulls on an end of the loose chain portion or additional weight is attached to the end stopper.

11. A method for an adjustment operation to adjust a tension in a two-section mooring line with the connecting system according to claim 1, the method comprising the following steps:

a) attaching a temporary pulling mechanism to the connecting device and pulling with the temporary pulling mechanism the connection device to move tension from said chain segment of the upper mooring line section to said pulling mechanism;

b) disengaging a locking surface of the locking element from the chain segment;

c) lifting said locking element;

d) transferring tension from the temporary pulling mechanism back to the upper mooring line section by slackening said temporary pulling mechanism;

e) moving said chain segment through the connecting device passing said locking element to lengthen the upper mooring line section;

f) re-engaging said locking surface of the locking element with the chain segment at a new mooring line length; and g) removing said temporary pulling mechanism.

* * * * *